US007261519B2

(12) United States Patent
Porter

(10) Patent No.: US 7,261,519 B2
(45) Date of Patent: Aug. 28, 2007

(54) ASSEMBLY INCLUDING A FIXTURE AND SELF-ALIGNING CHAIN

(76) Inventor: David H. Porter, W. 6665 Dividing Ridge Rd., Monticello, WI (US) 53570

( * ) Notice: Subject to any disclaimer, the term of this patent is extended or adjusted under 35 U.S.C. 154(b) by 155 days.

(21) Appl. No.: 11/029,199

(22) Filed: Jan. 4, 2005

(65) Prior Publication Data

US 2005/0186078 A1 Aug. 25, 2005

Related U.S. Application Data

(60) Provisional application No. 60/604,448, filed on Aug. 25, 2004, provisional application No. 60/546,418, filed on Feb. 20, 2004.

(51) Int. Cl.
*F01D 25/00* (2006.01)

(52) U.S. Cl. ..... 416/224 R; 416/5

(58) Field of Classification Search ..... 416/244 R, 416/5; 362/404, 405, 406, 430, 96, 407; 59/78.1, 84, 91, 80
See application file for complete search history.

(56) References Cited

U.S. PATENT DOCUMENTS

| | | | | |
|---|---|---|---|---|
| 1,233,538 | A | 7/1917 | Alden | |
| 1,430,402 | A | 9/1922 | Perry | |
| 1,596,607 | A | 8/1926 | Forstner | |
| 1,686,362 | A | 10/1928 | Arras | |
| 1,718,368 | A | 6/1929 | Laupot | |
| 3,771,309 | A | 11/1973 | Peters | |
| 4,351,506 | A | 9/1982 | Ohai | |
| 5,531,065 | A | 7/1996 | Rosenwasser | |
| 5,590,516 | A | 1/1997 | Schwartz | |
| 6,017,190 | A * | 1/2000 | Lackey | 416/244 R |
| 6,256,793 | B1 | 7/2001 | Arias et al. | |
| 6,460,323 | B1 | 10/2002 | Rosenwasser et al. | |
| 6,519,778 | B2 | 2/2003 | Arias et al. | |
| 6,805,471 | B2 * | 10/2004 | Strelnieks | 362/407 |

* cited by examiner

*Primary Examiner*—Edward K. Look
*Assistant Examiner*—Dwayne J White
(74) *Attorney, Agent, or Firm*—Tarolli, Sundheim, Covell & Tummino LLP

(57) ABSTRACT

A fixture assembly having a self-aligning chain and a fixture suspended by the chain are disclosed. The chain has a top link connected to a point of attachment and a bottom link connected to the fixture. The chain has at least one juncture between the top and bottom links. The juncture has first and second link-ends. The first link-end is configured in the shape of a vee with diverging legs and spaced-apart edges extending longitudinally along the legs. The second link-end has a portion nestled into the vee of the first link-end contacting the vee of the first link-end at four contact points, each edge of the first link-end having a contact point. All links of the chain are connected by said juncture thereby restraining the fixture from turning with respect to its at-rest vertical axis or attitude. The present invention also resides in a ceiling fan assembly having a ceiling fan and a chain suspending the fan. When the fan is turned on, the rotating blades create a torque that tends to rotate the fan housing in a direction opposite to that of the fan blades. The chain when pulled downwardly by the weight of the fan is configured to resist this rotation.

26 Claims, 6 Drawing Sheets

ASSEMBLY INCLUDING A FIXTURE AND SELF-ALIGNING CHAIN

RELATED APPLICATIONS

Related applications are:

Provisional Application Ser. No. 60/546,418 filed Feb. 20, 2004 for "Fixture Assembly Comprising self-aligning Chain"; and.

Provisional Application Ser. No. 60/604,488 filed Aug. 25, 2004 for "Chain Suspended Ceiling Fan".

The benefit of earlier filing dates of the foregoing provisional application is heareby claimed. The disclosures in the aforementioned provisional applications are hereby incorporated herein in their entirety by this reference thereto.

BACKGROUND OF THE INVENTION

1. Technical Field

The present invention relates to a fixture assembly comprising a self-aligning chain and a fixture that is suspended by the chain. The chain when pulled downwardly by the weight of the fixture resists rotation of the fixture and displacement of the fixture from its vertical axis or attitude. The chain quickly returns the fixture to its original orientation and attitude if displaced from that orientation and attitude.

In an embodiment of the present invention, the fixture is a ceiling fan. The fan can be portable or direct wired. When the fan is turned on, the rotating fan blades create a torque that tends to rotate the fan housing in a direction opposite to that of the fan blade rotation. The chain, when pulled downwardly by the weight of the ceiling fan, is configured to resist the housing rotation and displacement of the fan from its vertical axis and attitude.

2. Brief Description of the Prior Art

U.S. Pat. No. 1,686,362 to Arras discloses an electric fixture comprising components stamped from sheet material. The components include a globe 15 (FIG. 1) and a chain suspending the globe from a ceiling. The chain comprises a plurality of sections 1 made of sheet material cut into blanks as shown in FIG. 4 of the patent. The blanks are then bent to form the hollow chain sections 1 shown in FIG. 6 of the patent. The sections 1 have hook ends 6 and 7. In the embodiment of FIG. 6, two hollow chain sections 1 are connected by a split link. The split link is also formed of sheet material. The purpose of the hollow sections 1 is to provide a channel through which an electric cord is threaded. The patent makes reference to upper and lower units 11 and 12 (FIG. 1) connected to canopy 13 and globe 15, respectively, but gives no details concerning the construction of the units 11 and 12.

Ceiling fans are supported conventionally by affixing them directly to a ceiling outlet box and suspending them downwardly on a rigid metal tube often referred to as a stem or downrod. In this respect, the fan is non-portable. This support arrangement can also be used with steeply angled ceilings, but it requires extra hardware and is very difficult to install. One object of the present invention is to provide a ceiling fan suspension that allows the fan to be positioned at a desired location irrespective of the location of the electrical outlet box or a source of power. Another object of the present invention is to provide a simple means for suspending a ceiling fan from a steeply angled ceiling.

BRIEF DESCRIPTION OF THE PRESENT INVENTION

The present invention relates to a fixture assembly. The assembly comprises a chain and a fixture suspended in a vertical axis by the chain. The chain comprises a top link connected to a point of attachment and a bottom link connected to the fixture. The chain may comprise a plurality of intermediate links between the top and bottom links. The chain has at least one juncture between the top link and the bottom link. The juncture consists of a first link-end of one link and a second link-end of a second link. The first link-end is configured in the shape of a vee with diverging legs and spaced-apart edges extending longitudinally along the legs. The second link-end comprises a portion of the second link nestled into the vee of the first link-end contacting the vee of the first link-end at four contact points, each edge of the first link-end having a contact point. All links of the chain are connected by said juncture thereby restraining the fixture from turning with respect to its at-rest orientation or displacement from its at-rest vertical axis or attitude.

Preferably, the vee angle of said first link-end is about 90 degrees or less.

The present invention also resides in an embodiment comprising a ceiling fan and a suspension for the fan comprising a chain configured to resist rotation of the fan when the fan is turned on.

In this embodiment, the chain preferably comprises a top link connected to a point of attachment, a bottom link connected to the fan assembly, and at least one juncture between the top link and the bottom link. Each juncture comprises a first link-end in the shape of a vee, and a second link-end having a portion nestled into the bottom of the first link-end vee so as to resist rotation of the second link-end with respect to the first link-end.

In another embodiment of the present invention, the suspension for a ceiling fan comprises a swag kit. The kit comprises a splice compartment, a conductor wire, a ground wire, an in-line switch, a ceiling mounting, and a chain for suspending a ceiling fan from the ceiling mounting. The chain is configured to resist rotation of the ceiling fan when the ceiling fan is turned on.

BRIEF DESCRIPTION OF THE DRAWINGS

The present invention and advantages thereof will become more apparent after reading the following specification with reference to the accompanying drawings, in which.

DETAILED DESCRIPTION OF THE PRESENT INVENTION

Figure 1:
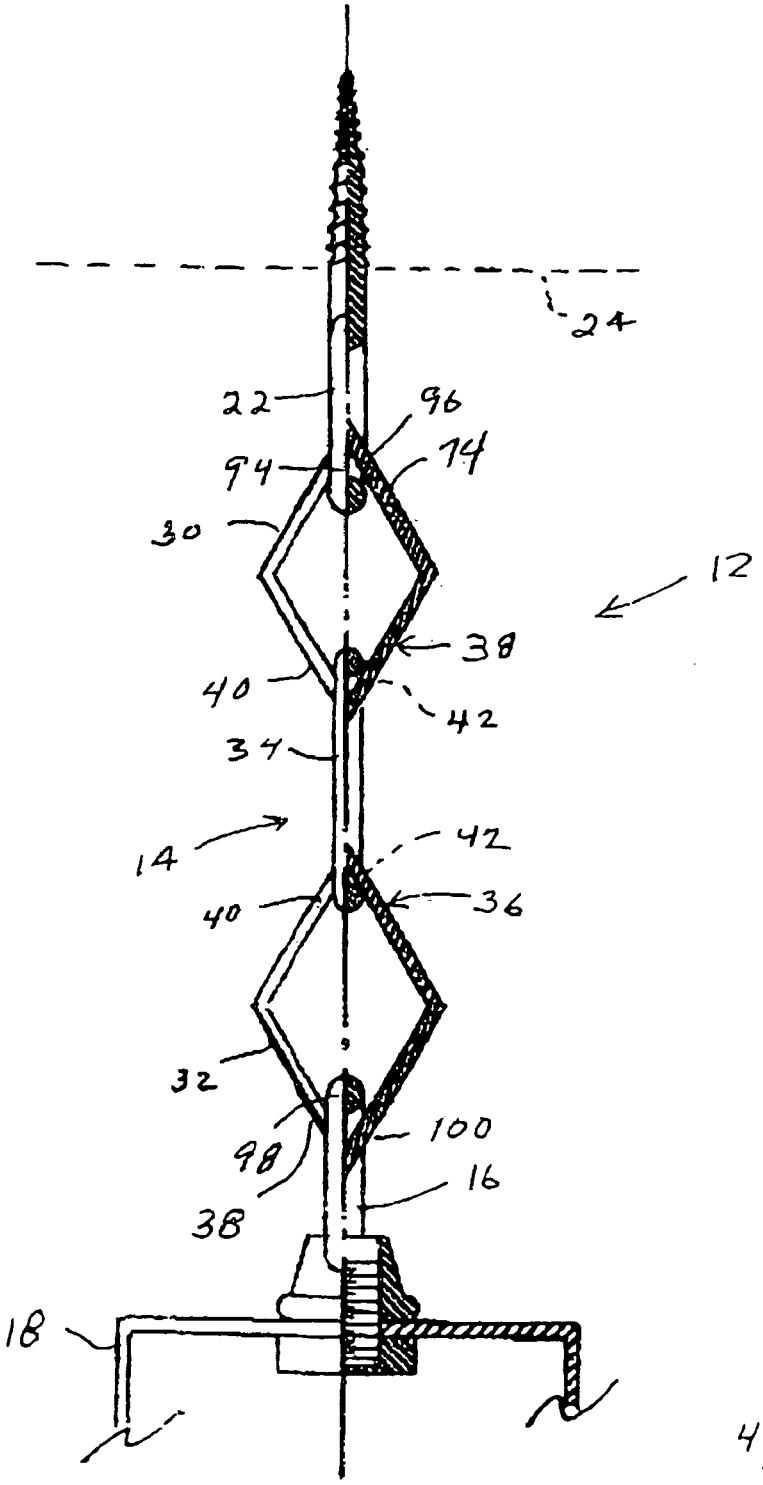
FIG. 1 is a partial section, side elevation view of a fixture assembly including a self-aligning chain in accordance with the present invention.
Figure 2A:
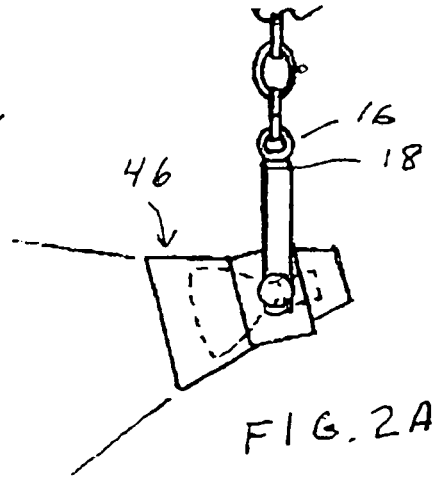
FIG. 2A is a partial side elevation view of the fixture assembly of FIGS. 1 and 2 showing an example of a fixture suspended by the self-aligning chain.
Figure 2:
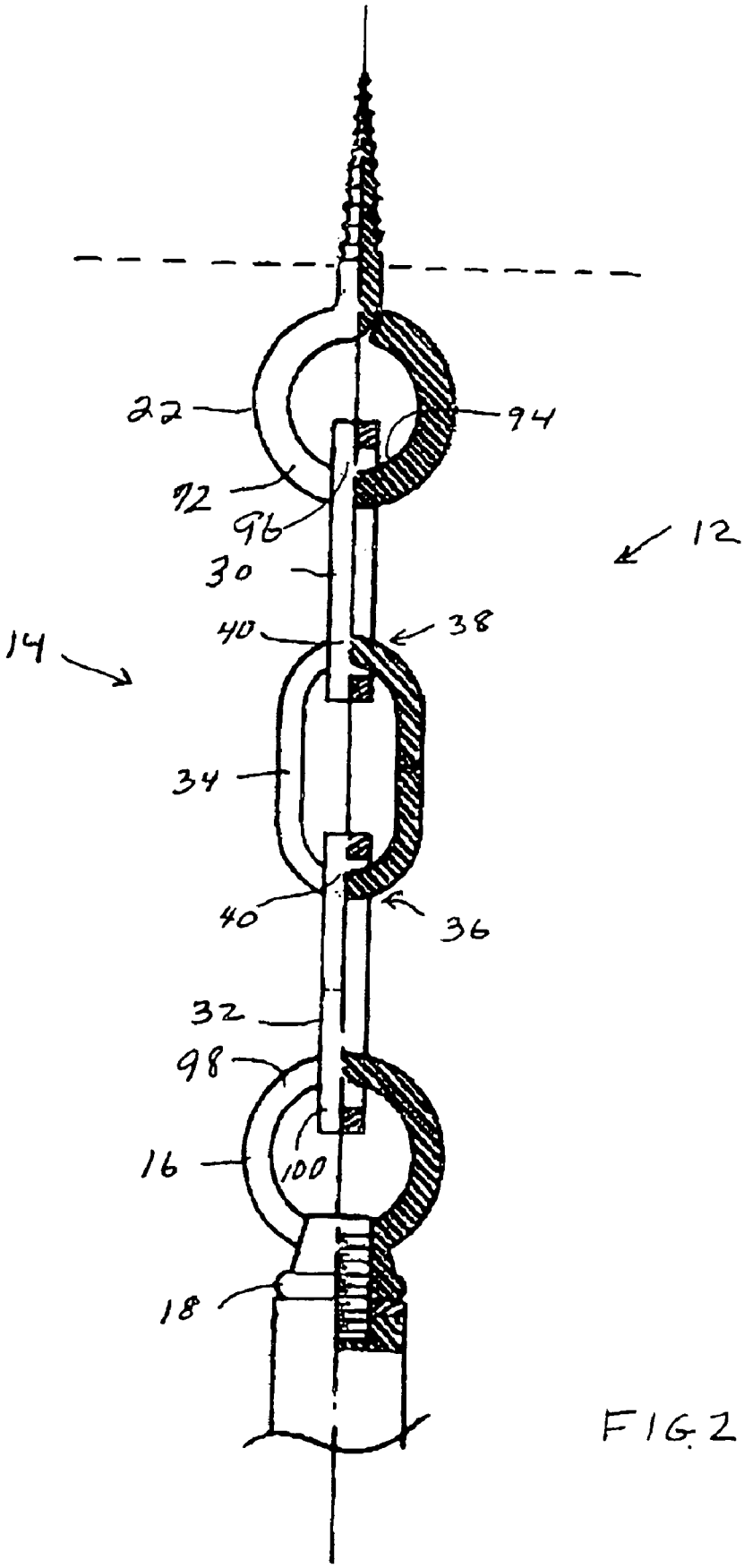
FIG. 2 is a partial section, side elevation view of the fixture assembly of FIG. 1 taken at right angles to the view of FIG. 1.

Referring to FIGS. 1 and 2, a fixture assembly 12 in accordance with the present invention is shown. The fixture assembly 12 comprises a chain 14. The chain 14 includes a lower fixture link 16 and fixture connector 18 at the bottom end of the fixture link 16. For purposes of the present application, the fixture link 16 shall be considered a component part of the chain 14 of the present invention. The fixture connector 18, for purposes of the present application, shall be considered the equivalent of a fixture or object suspended by the fixture chain 14.

Objects or fixtures 18 suspended by the fixture chain 14 are those requiring directional orientation and a relatively fixed vertical axis or attitude. Specific examples are accent lights; pool table lights; four light or rectangular chandeliers; suspended spot lights; suspended bird feeders; suspended kitchen pot racks or planters; suspended fluorescent work lights; suspended video cameras, security devices and monitors; suspended switches; ornament chains; suspended clothing and other merchandise; restaurant displays; and many others for which the directional orientation and attitude or axis are important criteria.

In the embodiment of FIGS. 1 and 2, the fixture assembly 12 includes a screw eye link 22. The screw eye link 22 is secured to and against a room ceiling 24 shown in dashed lines. For purposes of the present application, the screw eye link 22 shall also be considered a component part of the chain 14 of the present invention. Instead of a screw eye link 22, the chain 14 can be suspended from the ceiling 24 by other devices, such as a screw hook or a conventional canopy connector configured in a manner similar to the screw eye link 22. By way of example, the canopy connector may be an eye held by a bolt attached to a ceiling or other support. The bolt holds a canopy against the ceiling or other support, and in addition holds the canopy connector eye against the canopy.

Referring to FIGS. 1 and 2, the chain 14, in addition to the screw eye link 22 and the fixture link 16, may also comprise one or more additional links between the screw eye link 22 and the fixture link 16. In the embodiment of FIGS. 1 and 2, the chain 14 comprises an upper vee link 30, a lower vee link 32, and a connecting link 34 between the vee links 30 and 32. In the example of FIGS. 1 and 2, three links are shown between the screw eye link 22 and the fixture link 16. However, any number of alternating connecting and vee links can be employed. The chain 14 can also consist of just two links, the screw eye link 22 and the fixture link 16.

As shown in FIG. 1, the vee links 30 and 32 have a profile generally in the shape of a parallelogram with upper and lower vee-shaped link-ends 36 and 38. Each of the link-ends 36 and 38 comprises a pair of longitudinally extending, relatively straight, diverging legs 40 and 42 engaging the connecting link 34. The generally parallelogram profile of the vee links 30 and 32 gives the vee-shaped link-ends 36 and 38 inner angles of about 90 degrees. The inner angle of the vee at each end 36 and 38 is preferably about 90 degrees or less.

Side views, perpendicular to the view of FIG. 1, of the vee links 30 and 32 are shown in FIG. 2. As shown, the vee links 30 and 32 are generally planar in configuration. In the side view of FIG. 2, the intermediate connecting link 34 has a generally oval or elliptical profile. As shown in FIG. 1, the connecting link 34 is also generally planar.

FIG. 2A shows an object 46 affixed to the fixture connector 18. The object 46 in the embodiment of FIG. 2A is an accent light. An accent light is one that is focused in a particular direction, for instance to illuminate a painting on a wall, and its directional orientation and attitude or vertical axis are very important, and should always remain the same. The fixture chain 14 of the present invention, supporting the accent light (object 46) of FIG. 2A, accomplishes this result.

Figure 3:
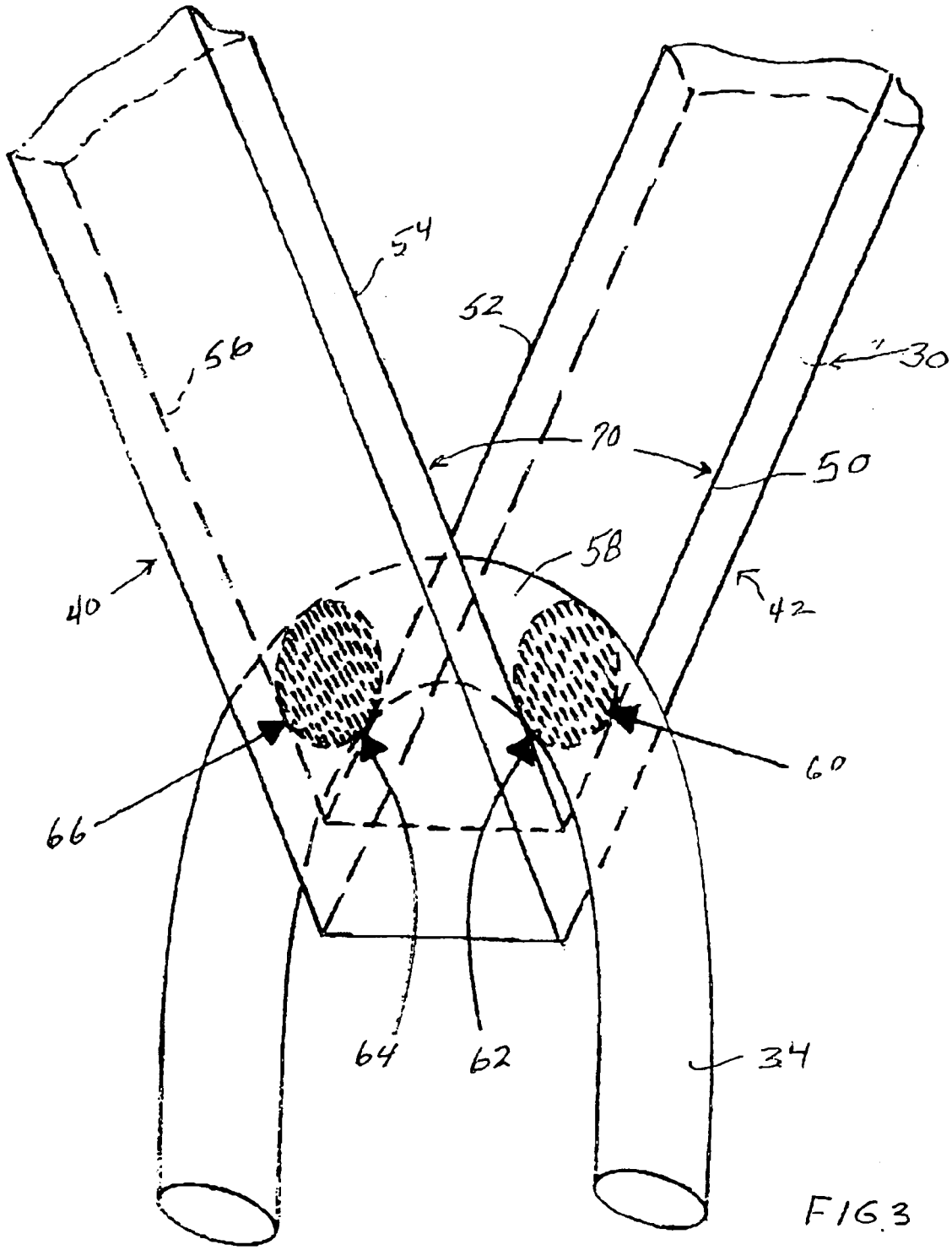
FIG. 3 is an enlarged, perspective view of a portion of the self-aligning chain of FIGS. 1 and 2 showing details of the connecting portions or joint of two links of the self-aligning chain in accordance with the present invention.
Figure 4:
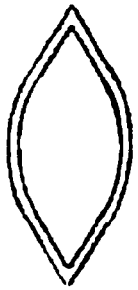
FIGS. 4, 5, 6, 7, 8, and 9 are side elevation views of links of the chain of FIG. 1 in accordance with embodiments of the present invention.
Figure 4A:
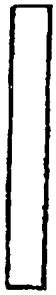
FIGS. 4A, 5A, 6A, 7A, 8A and 9A are side views of the links of FIGS. 4, 5, 6, 7, 8 and 9 taken at right angles to the views of FIGS. 4, 5, 6, 7, 8 and 9 respectively.
Figure 5:
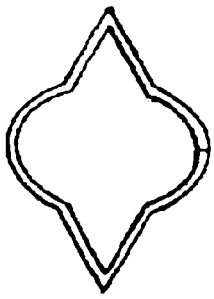
Figure 5A:
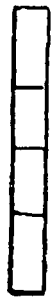
Figure 6:
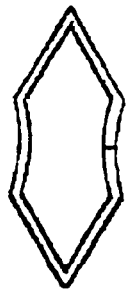
Figure 6A:
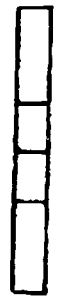
Figure 7:
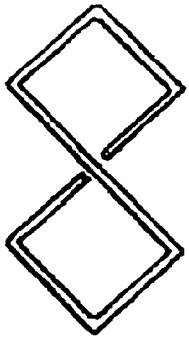
Figure 7A:
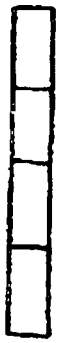
Figure 8:
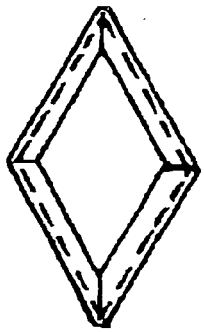
Figure 8A:
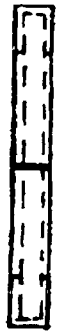
Figure 9:
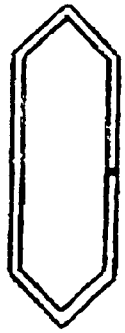
Figure 9A:
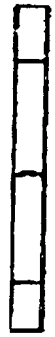

Details of the contact or juncture between a vee link 30 of the present invention and a connecting link 34 of the present invention can be seen by reference to FIG. 3. The diverging legs 40 and 42 of the vee of the link 30 have parallel spaced-apart edges 50, 52, 54, and 56. The connecting link 34 has on oval portion 58 lying in a plane generally at right angles to the plane of the diverging legs 40 and 42. The oval portion 58 nestles into the vee of the vee link 30 between the diverging legs 40 and 42 and contacts the legs 40 and 42 at four contact points 60, 62, 64, and 66, each diverging edge 50, 52, 54, and 56 having a contact point.

The operation of the chain 14 should now be apparent. The weight of a fixture, for instance the accent light of FIG. 2A, draws the oval portion 58 of the connecting link 34 into the bottom of the vee of the vee link 30. The diverging legs 40 and 42 of the vee link 30 provide buttressing, spaced-apart contact points 60, 62, 64, and 66 that resist turning or change in attitude of the connecting link 34 with respect to the vee link 30. If one link is turned with respect to another, or is displaced in attitude, the weight of the fixture draws the oval portion of the connecting link 34 into the bottom of the vee of the vee link 30. This causes the links to revert to their original or at-rest orientations and attitudes with respect to each other.

Preferably, the angle 70 between the diverging legs 40 and 42 of the vee link 30 is about 90 degrees or less. Generally, the smaller the angle 70, the greater the resistance against turning or change in attitude of one link with respect to another. Also, the wider the vee link 30 (the distance between contact points 60 and 64, or the distance between contact points 62 and 66), the greater the resistance against turning or change in attitude of one link with respect to another. Preferably, the width of a vee-end of the vee link 30 is equal to or more than the angular distance between the contact points 60 and 62, or between contact points 64 and 66 (that line or side of the vee-end opposite the apex of the vee-end).

The vee links 30 and 32 can have a profile other than the parallelogram configuration shown in FIG. 1. For instance, the vee links 30 and 32 can have a generally trapezoidal, rectangular or square profile. Examples of other suitable configurations are shown in FIGS. 4-9. From a practical point of view, the vee links are generally planar as shown in FIGS. 4A, 5A, 6A, 7A, 8A, and 9A. However, the ends could be rounded, or slightly oval as long as they are generally vee-shaped and provide the four points of contact with the connecting link.

Figure 10:
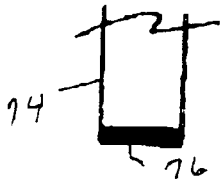
FIGS. 10, 11, 12, 13, 14 and 15 are partial section, schematic views showing various cross-sections of chain links in accordance with the present invention.
Figure 11:
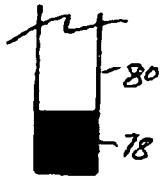
Figure 12:
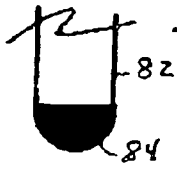
Figure 13:
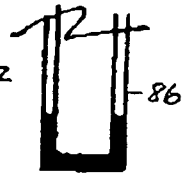
Figure 14:
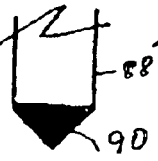
Figure 15:
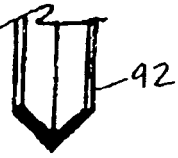

The cross-section of a vee link 30 or 32 can be other than the rectangular cross section shown in FIGS. 1 and 2. Examples are shown in FIGS. 10-15. In FIG. 10, the thickness of the link 74, in cross-section 76, is small. This link would be suitable for relatively lightweight objects suspended by the chain 14. In FIG. 12, the thickness in cross-section 78 is greater making this link 80 suitable for heavier objects. In FIG. 12, The link 82 has a rounded outer edge 84. In FIG. 13, the link 86 is formed in the shape of a channel in cross-section. In FIG. 14, the link 88 has a triangular cross-section 90, and in FIG. 15, the link has a trough cross-section. Any concave inner surface can be employed as long as it provides the desired four contact points.

Similarly, the connecting link 34 of FIGS. 1, 2 and 3 can have a profile other than the oval or elliptical profile shown. It can have a round or circular profile, or practically any geometrical profile providing a surface capable of seating against the vee link at the four contact points 60, 62, 64, and 66. The connecting links 34 could have the same configuration as the vee links. The cross-section of the connecting link also is not critical as long as it provides a surface capable of seating against the vee link at the four contact points 60, 62, 64, and 66.

In the present invention, the self-aligning principle between the vee links and the connecting links is also employed in the contact or juncture between the screw eye 22 and the vee link 30, and in the contact or juncture between the link 16 and the vee link 32. In FIG. 1, the screw eye 22 has a rounded portion 94 which engages the vee 96 of the vee link 30, and the link 16 has a rounded portion 98 which engages the vee 100 of the vee link 32. If the fixture chain consisted only of a fixture link and a screw eye link (or other top link), then one would have a vee-end and the other a portion that nestles into the vee of the vee-end.

In an embodiment of the present invention, the fixture 18 is a portable ceiling fan. This embodiment is illustrated in FIG. 16.

Figure 16:
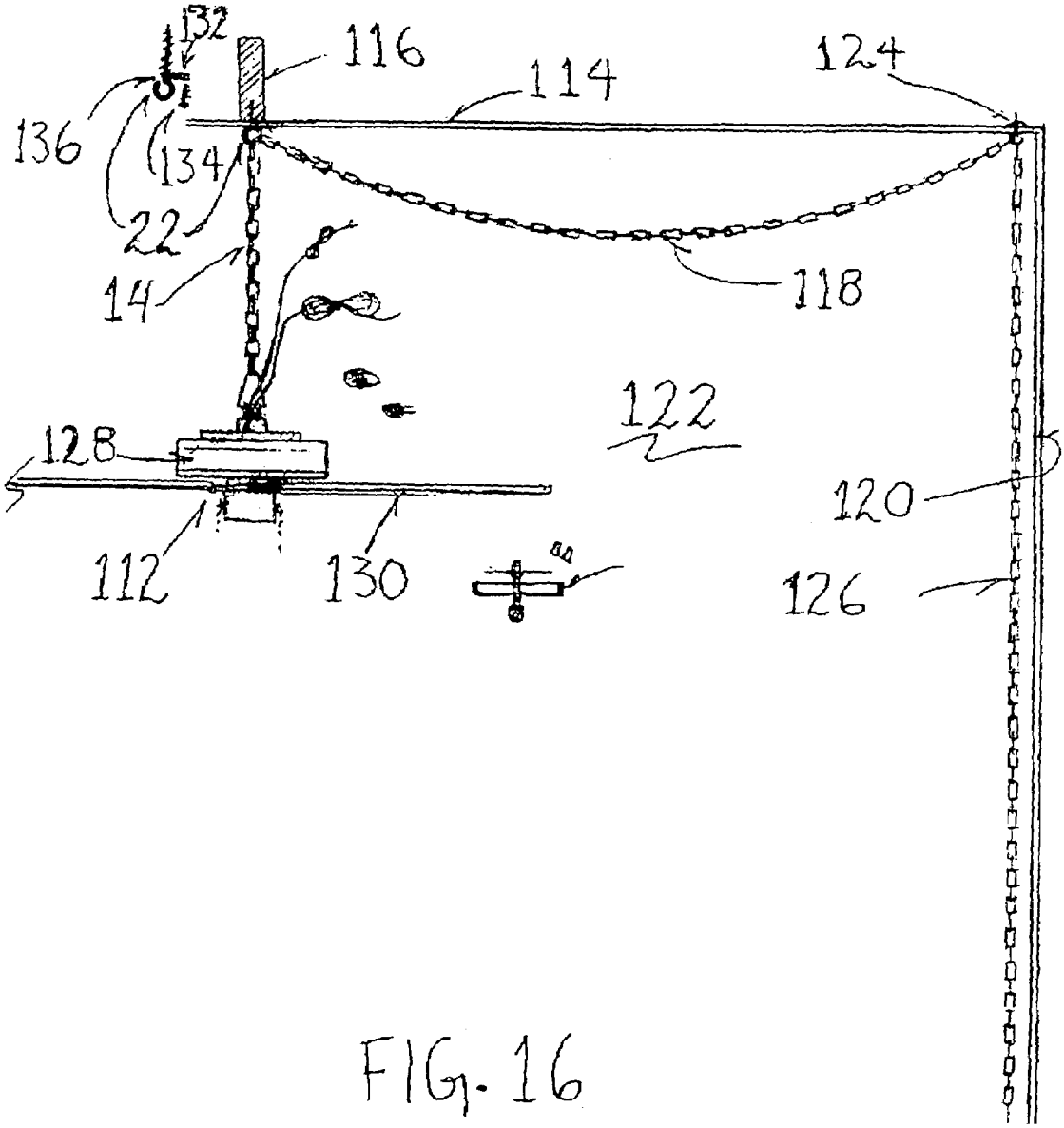
FIG. 16 is an elevation view of a portable chain suspended ceiling fan in accordance with an embodiment of the present invention.

Referring to FIG. 16, a portable ceiling fan 112 is illustrated. The ceiling fan 112 is also referred to as a paddle fan. The ceiling fan 112 is suspended from a ceiling 114 by a chain 14. A screw eye 22 is threaded into a ceiling joist 116, and the chain 14 connects to the screw eye 22. The chain 14 comprises a portion 118 that extends to the side 120 of a room 122, hooked to a swag hook 124. The chain further includes a chain length end 126 that extends downwardly from swag hook 124.

The ceiling fan 112 comprises a fan housing 128 that contains a fan motor (not shown). The fan 112 also comprises fan blades 130 rotated by the fan motor. Conventionally, a ceiling fan is affixed directly to a ceiling or is suspended from a ceiling by a rigid metal tube called a stem or downrod. A rigid stem is necessary because when the fan is turned on, rotation of the fan blades creates a torque that tends to rotate the fan housing in a direction opposite to the direction of rotation of the fan blades. The rigid, metal stem or direct affixation is necessary to prevent the housing rotation.

Affixing a fan directly to a room ceiling, or suspending the fan from the room ceiling by a rigid fixed-length metal stem, makes the fan non-portable. It is an object of this embodiment of the present invention to provide a suspension for a ceiling or paddle fan that allows the fan to be moved from one height to another or one location to another in a room. By the present invention, a ceiling fan can be strategically placed at any desired location and height in a room regardless of the source of power, and it can be moved from one location to another. When not in use, the fan can be readily removed from its location and conveniently stored.

Affixing the fan directly to a room ceiling under an outlet box and suspending the fan from the room ceiling by a rigid metal stem also prevents the ceiling fan from being used with a steeply angled ceiling with a conventionally provided ceiling canopy. With a steeply angled ceiling, the stem connection at the canopy is limited in the number of degrees it can be angled from the plane on which the canopy is mounted. If the canopy is mounted to the steep angle of the ceiling, the stem cannot reach the vertical position necessary for fan operation. It is also an object of this embodiment of the present invention to provide an easy means for suspending a ceiling fan from a steeply angled ceiling.

In the present embodiment of the present invention, a critical aspect is configuring the chain 14 so that it functions as a rigid metal stem or tube when pulled downward by the weight of the fan. Preferably, the chain 14 has the configuration of FIGS. 1, 2, and 3. Surprisingly, it was found that when the chain 14 had the configuration of FIGS. 1, 2, and 3, it prevented the fan housing 128 from rotating when the fan was turned on, or from being displaced from its vertical orientation or attitude. But by being a chain, connected to a screw eye 22, it allowed the fan 112 to be moved easily from one location in a room to another, or even from room to room, or removed and stored. It also permitted the fan 112 to be suspended from a steeply angled ceiling.

Preferably, the screw eye 22 or other connector is provided with (referring to FIG. 16) a tab 132 and screw 134 to keep the screw eye 22 from turning. The screw eye also has an opening 136 that allows the chain 14 to be easily disconnected from the screw eye 22.

Figure 17:
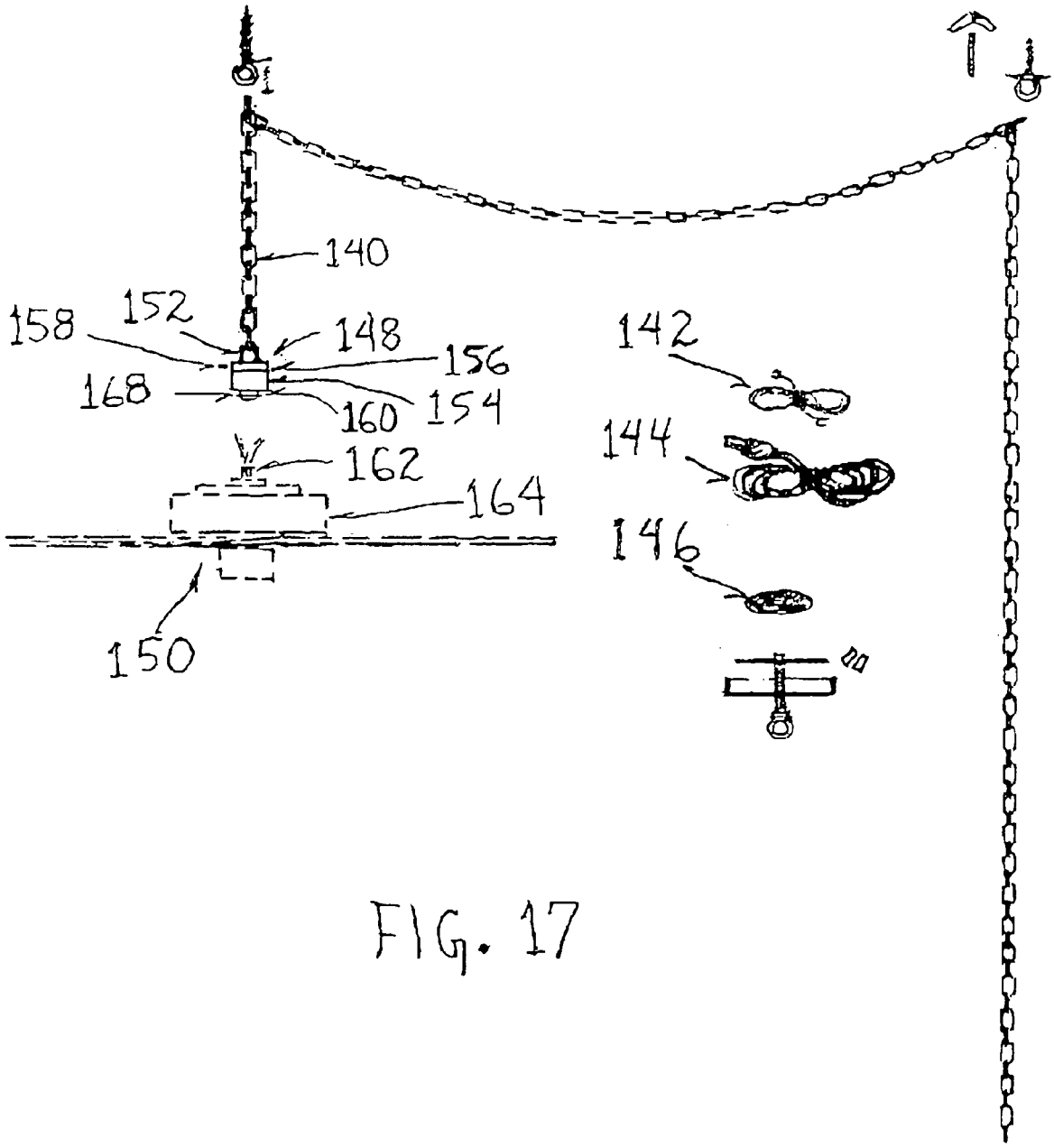
FIG. 17 is an elevation view of a ceiling fan and a chain swag kit for suspending the ceiling fan in accordance with another embodiment of the present invention.

In the embodiment of FIG. 17, the present invention resides in a chain swag kit that can be used for adapting existing fans for portability. The kit comprises a chain 140 configured similar to the chain 14 of the embodiment of FIG. 16. The kit also comprises a ground wire 142, conductor wires 144, an in-line switch 146, and hardware 148 to connect the chain 140 to an existing fan 150. The hardware 148, by way of example, includes a loop 152 functioning as a chain end, a splice compartment 154, and a screw-on cap 156 which screws on to the top of the splice compartment 154. The function of the splice compartment 154 is to provide an housing for conductor and ground wire connections. The splice cap 156 allows the splice compartment 154 to be opened to make the connections. The loop 152 is affixed to the splice cap 156. A set-screw 158 locks the screw cap 156 in place on the splice compartment 154. The splice compartment 154 has a lower female connector end 160 which threads onto a male connector part 162 of a conventional fan housing 164. A cotter key 168 prevents the end 160 from turning with respect to the part 162.

From the above description of the invention, those skilled in the art will perceive improvements, modifications, and changes. Such improvements, modifications and changes within the skill of the art are intended to be covered by the appended claims.

What is claimed is:

1. A fixture assembly comprising a) a chain, and b) a fixture suspended in a vertical axis by the chain, said chain comprising a top link connected to a point of attachment, a bottom fixture link connected to the fixture, and at least one juncture between the top link and the bottom link, said juncture comprising i) a first link-end configured in the shape of a vee with diverging legs and spaced apart edges extending longitudinally along the legs; and ii) a second link-end comprising a portion nestled into the vee of the first link-end contacting the first link-end at four contact points, each edge having a contact point, wherein all links of the chain are connected by said juncture restraining the fixture from turning with respect to its at-rest orientation or displacement from its at-rest vertical axis.

2. The fixture assembly of claim 1 wherein the vee angle of the first link-end is about 90 degrees or less.

3. The fixture assembly of claim 1 wherein said fixture is a ceiling fan.

4. A fixture assembly comprising a) a chain, and b) a fixture suspended by the chain, said chain comprising a top link connected to a point of attachment, a bottom link connected to said fixture, one or more links between said top link and said bottom link, and a juncture between each pair of links, each said juncture comprising;

i) a first link-end configured into the shape of a vee with diverging legs and spaced apart edges extending longitudinally along the legs, the vee having a width dimension and a side dimension opposite the apex of the vee and said width dimension being equal to or more than said side dimension, and ii) a second link-end comprising a portion nestled into the vee of the first link-end at four contact points, each edge having a contact point, wherein said junctures restrain the fixture from turning with respect to its at-rest orientation or displacement from its at-rest vertical axis.

5. A fixture assembly comprising a) a chain, and b) a fixture supported by the chain;

c) wherein said chain comprises at least two links connected together, i) said first link comprising an end configured in the shape of a vee including diverging legs, each diverging leg having parallel spaced-apart edges extending longitudinally along the legs, the vee having a width dimension between the edges on each leg and the vee having a side dimension opposite the apex of the vee, the width dimension being equal to or greater than the side dimension;

ii) said second link comprising a portion nestled into the vee of the first link contacting the edges of the first link simultaneously at four points along said edges restraining the second link from turning with respect to the first link or displacement from its at-rest axis.

6. The fixture assembly of claim 5 wherein all links of said chain are configured and connected in the manner of said first and second links.

7. A ceiling fan assembly comprising a fan, a flexible suspension for the fan configured to resist rotation of the fan when the fan is turned on.

8. The fan of claim 7 wherein said flexible suspension includes a chain having a top link connected to a point of attachment, a bottom link connected to the fan, and at least one juncture between the top link and the bottom link, said juncture comprising i) a first link-end configured in the shape of a vee with diverging legs and spaced-apart edges extending longitudinally along the legs;

ii) a second link-end comprising a portion nestled into the vee of the first link-end contacting the first link-end at four contact points, each edge having a contact point, wherein all links of the chain are connected by said juncture restraining the fan from turning with respect to its at-rest orientation or displacement from its at-rest vertical axis.

9. The fan of claim 8 wherein the vee of said first link-end has a width dimension and a side dimension opposite the apex of the vee and said width dimension is equal to or greater than said side dimension.

10. The ceiling fan of claim 7 wherein said suspension is a chain configured to resist rotation of the fan when the fan is turned on.

11. A ceiling fan assembly comprising a) a chain, and b) a fan suspended by the chain, said chain comprising a top link connected to a point of attachment, a bottom link connected to said fan, one or more pair of links between said top link and said bottom link, and a juncture between each pair of links, each said juncture comprising;

i) a first link-end configured in the shape of a vee with diverging legs and spaced-apart edges extending longitudinally along the legs, and ii) a second link-end comprising a portion nestled into the vee of the first link-end at four contact points, each edge having a contact point, wherein said junctures restrain the fan from turning with respect to its at-rest orientation or displacement from its at-rest vertical axis.

12. The ceiling fan of claim 11 wherein the vee of said first link has a width dimension and a side dimension opposite the apex of the vee and said width dimension is equal to or more than said side dimension.

13. A ceiling fan comprising a) a chain;

b) a fan supported by the chain;

c) wherein said chain comprises at least two links connected together i.) said first link comprising an end configured in the shape of a vee including diverging legs, each diverging leg having parallel spaced-apart edges extending longitudinally along the legs, the vee having a width dimension between the edges on each leg and the vee having a side dimension opposite the apex of the vee, the width dimension being equal to or greater than the side dimension;

ii.) said second link comprising a portion nestled into the vee of the first link contacting the edges of the first link simultaneously at four points along said edges restraining the second link from turning with respect to the first link or displacement from its at-rest axis.

14. A kit for adapting a ceiling fan for portability comprising a supporting chain and hardware for connecting the chain to the ceiling fan, said chain comprising a top link connectable to a point of attachment, a bottom link connectable to the fan, and at least one juncture between the top link and the bottom link, said juncture comprising a) a first link-end configured in the shape of a vee with diverging legs and spaced-apart edges extending longitudinally along the legs; and b) a second link-end comprising a portion nestled into the vee of the first link-end contacting the first link-end at four contact points, each edge having a contact point, wherein all links of the chain are connected by said juncture restraining the fan from turning with respect to its at-rest orientation or displacement from its at-rest vertical axis.

15. A fixture assembly comprising a) a chain, and b) a fixture suspended in a vertical axis by the chain, said chain comprising a top link connected to a point of attachment, a bottom fixture link connected to the fixture, and at least one juncture between the top link and the bottom link, said juncture comprising i) a first link-end configured in the shape of a vee with diverging legs and spaced apart edges extending longitudinally along the legs; and ii) a second link-end comprising a portion nestled into the vee of the first link-end contacting the first link-end ii) a second link-end comprising a portion nestled into the vee of the first link-end contacting the first link-end at four contact points, each edge having a contact point, wherein all links of the chain are connected by said juncture restraining the fixture from turning with respect to its at-rest orientation or displacement from its at-rest vertical axis, the vee angle of the first link-end is about 90 degrees or less, the juncture is between a first generally planar link having a profile generally that of a parallelogram and a second link which is a planar wire link having a generally oval profile in the portion nestled into a vee of the first link.

16. The fixture assembly of claim 15 comprising a plurality of alternate first and second links.

17. The fixture assembly of claim 1 wherein the vee of said first link-end has a width dimension and a side dimension opposite the apex of the vee and said width dimension is equal to or greater than said side dimension.

18. A fixture assembly comprising a chain having a plurality of links, a first link of said plurality of links having first and second legs which are interconnected at an intersection between said first and second legs, said first leg having a first edge portion which extends from the intersection between said first and second legs in a direction transverse to a first edge portion of said second leg, said first leg having a second edge portion which extends from the intersection between said first and second legs in a direction transverse to a second edge portion of said second leg, a second link of said plurality of links having a first portion which is disposed in engagement with said first edge portion of said first leg of said first link and with said first edge portion of said second leg of said first link, said second link of said plurality of links having a second portion which is disposed in engagement with said second edge portion of said first link and with said second edge portion of said second link, said second link of said plurality of links having a third portion which is disposed between said first and second portions of said second link, said third portion of said second link spans a portion of the intersection between said first and second legs of said first link and is free of engagement with said portion of the intersection spanned by said third portion of said second link, and a fixture suspended by said chain, said first and second links cooperating to restrain said fixture against turning movement about a longitudinal central axis of said chain when said fixture is in an at-rest orientation.

19. A fixture assembly as set forth in claim 18 wherein said first edge portion of said first leg of said first link extends parallel to and is spaced from said second edge portion of said first leg of said first link, said first edge portion of said second leg of said first link extends parallel to and is spaced from said second edge portion of said second leg of said first link.

20. A fixture assembly as set forth in claim 18 wherein said first leg of said first link has a polygonal cross sectional configuration as viewed in a plane extending perpendicular to a central axis of said first leg, said second leg of said first link has a polygonal cross sectional configuration as viewed in a plane extending perpendicular to a central axis of said second leg, said first and second portions of said second link having an arcuate cross sectional configuration as viewed in a plane extending perpendicular to a central axis of said first and second portions of said second link.

21. A fixture assembly as set forth in claim 18 wherein said first and second edge portions of said first leg of said first link have a linear configuration and said first and second edge portions of said second leg of said first link have a linear configuration.

22. A fixture assembly as set forth in claim 18 wherein said first leg of said first link has a flat side surface which extends between said first and second edge portions of said first leg of said first link, second leg of said first link has a flat side surface which extends between said first and second edge portions of said second leg of said first link, said flat side surface of said first leg of said first link is disposed in a plane which intersects a plane in which said flat side surface of said second leg of said first link is disposed.

23. A fixture assembly as set forth in claim 18 wherein said fixture is a fan.

24. A fixture assembly as set forth in claim 18 wherein said fixture is a light fixture.

25. A fixture assembly as set forth in claim 18 where a central axis of said first leg of said first link intersects a central axis of said second leg of said first link at an angle of 90 degrees or less.

26. A fixture assembly as set forth in claim 18 wherein a distance between the first and second edge portions of the first leg of the first link, as measured along a line extending perpendicular to the first edge portion of the first leg, is equal to or more than a distance between a point of engagement of said first portion of said second link with said first edge portion of said first leg of said first link and a point of engagement of said first portion of said second link with said first edge portion of said second leg of said first link.

* * * * *